US006706144B1

(12) United States Patent
Furman, Jr. et al.

(10) Patent No.: US 6,706,144 B1
(45) Date of Patent: Mar. 16, 2004

(54) METHOD OF DEWATERING PULP

(75) Inventors: Gary S. Furman, Jr., St. Charles, IL (US); James J. Svarz, Naperville, IL (US)

(73) Assignee: Ondeo Nalco Company, Naperville, IL (US)

( * ) Notice: Subject to any disclaimer, the term of this patent is extended or adjusted under 35 U.S.C. 154(b) by 64 days.

(21) Appl. No.: 10/174,230

(22) Filed: Jun. 18, 2002

(51) Int. Cl.[7] ..... D21C 9/18; B01D 43/00
(52) U.S. Cl. ..... 162/72; 162/77; 210/728
(58) Field of Search ..... 162/5, 10, 56, 162/72, 75–77, 82, 101, 156, 164.5, 164.7, 165, 168.1, 173, 179, 183, 185; 210/727–728, 749, 928; 209/5; 576/DIG. 1, DIG. 2, DIG. 3; 524/922; 34/329, 337–340, 342, 348–351

(56) References Cited

U.S. PATENT DOCUMENTS 4,039,466 A * 8/1977 Matsuda et al. ..... 252/194
4,062,721 A * 12/1977 Guyer et al. ..... 162/101
4,107,073 A * 8/1978 Maciaszek ..... 516/120
4,210,531 A * 7/1980 Wang et al. ..... 210/727
4,985,162 A * 1/1991 Cole ..... 252/60
5,395,438 A * 3/1995 Baig et al. ..... 106/164.51
5,436,094 A * 7/1995 Horimoto et al. ..... 429/254
5,807,502 A * 9/1998 Wollenweber et al. ..... 516/18

FOREIGN PATENT DOCUMENTS

JP 64-040691 * 2/1989 ..... D21C/9/00
WO WO 02/18704 A1 7/2002

OTHER PUBLICATIONS

Smook, G.A., Handbook for Pulp and Paper Technologists, pp. 41–43 (1992).*

* cited by examiner

*Primary Examiner*—Peter Chin
*Assistant Examiner*—Eric Hug
(74) *Attorney, Agent, or Firm*—Michael B. Martin; Thomas M. Breininger

(57) ABSTRACT

A method of dewatering an aqueous cellulosic pulp slurry comprising adding to an aqueous slurry of washed cellulosic pulp an effective dewatering amount of a mixture of one or more nonionic surfactants and one or more anionic surfactants.

8 Claims, No Drawings

METHOD OF DEWATERING PULP

TECHNICAL FIELD

This invention concerns the use of a mixture of nonionic and anionic surfactants to assist in the dewatering of aqueous slurries of cellulosic pulp.

BACKGROUND OF THE INVENTION

Various surfactants have been used to assist in the removal of water from aqueous slurries or mats of fibrous materials. For Example, the use of anionic surfactants to assist in the dewatering of cellulosic papermaking slurries on a fourdrinier or cylinder machine is disclosed in International Patent Application Number PCT/US01/20276. A method of dewatering an aqueous mineral wool slurry on fourdrinier machine assisted by an anionic, nonionic or cationic surfactant is disclosed in U.S. Pat. No. 4,062,721. There exists, however, an ongoing need for improved additives to improve the efficiency and flexibility of the dewatering process, particularly for market pulps, which are prepared at one site and then transported to the papermaking site.

SUMMARY OF THE INVENTION

We have discovered that using a combination of nonionic and anionic surfactants in a process for dewatering aqueous cellulosic slurries results in increased dewatering effectiveness over the use of either surfactant alone.

Accordingly, in its principal aspect, this invention is directed to a method of dewatering an aqueous cellulosic pulp slurry comprising a) adding to an aqueous slurry of washed cellulosic pulp an effective dewatering amount of a mixture of one or more nonionic surfactants and one or more anionic surfactants; and b) dewatering the pulp.

Use of nonionic surfactants in combination with anionic surfactants makes the anionic surfactants more efficient as a dewatering aid, allowing the same effectiveness (in terms of consistency improvement) at lower anionic surfactant dose and further provides the ability to achieve effectiveness levels not possible using anionic surfactants alone.

Lowering the anionic surfactant dose also decreases the amount of cationic demand introduced to the mill's water systems.

Finally, the dual surfactant system of this invention allows for greater flexibility in tailoring a dewatering program to a particular machine's dewatering needs regarding performance, runnability, and cost.

DETAILED DESCRIPTION OF THE INVENTION

Definitions of Terms

"Alcohol Alkoxy Sulfate" means an anionic surfactant compound of formula $R_2O(R_3CH_2CH_2O)_xSO_3^-M^+$ where $R_2$ is $C_8$–$C_{18}$ alkyl, $R_3$ is absent or methylene a from 1 to about 50. The alcohol alkoxy sulfate may be in the salt form where M a counterion such as Na, K, Mg, $NH_4$, and the like, or in the acid form where M is H. Representative alcohol alkoxy sulfates include sodium and ammonium lauryl ether sulfate. Alcohol alkoxy sulfates are available from Stepan Company, Northfield, Ill.

"Alcohol Alkoxylate" means a nonionic surfactant compound of formula $R_6O(C_2H_4O)_x(C_3H_6O)_yH$ where $R_6$ is $C_8$–$C_{24}$ alkyl, x is 1–20 and y is 1–20. the alcohol alkoxylate is prepared by reacting a $C_8$–$C_{24}$ alkyl alcohol, or mixture of $C_8$–$C_{24}$ alkyl alcohols, both designated herein as $R_6OH$, with propylene oxide and optionally ethylene oxide. The ethylene oxide and propylene oxide may be added in random or block fashion. Alcohol alkoxylates are available from Huntsman Corporation, Houston, Tex.

"Alcohol Ethoxylate" means a nonionic surfactant compound or mixture of compounds of formula $R_1O(CH_2CH_2O)_nH$ where $R_1$ is $C_5$–$C_{25}$ alkyl or $C_5$–$C_{25}$ hydroxyalkyl and n is 1–30. Preferred alcohol ethoxylates are those where $R_1$ is $C_8$–$C_{18}$ alkyl or $C_8$–$C_{18}$ hydroxyalkyl and n is 1–20. Alcohol ethoxylates are available from Union Carbide, Danbury, Conn. under the tradename Tergitol and from Sasol North America Inc., Houston, Tex. under the trade name Alfonic.

"Alcohol Sulfate" means compounds of the formula $R_2OSO_3M$, where $R_2$ and M are defined herein. Representative alcohol sulfates include sodium dodecyl sulfate, tetradecyl sulfate, ammonium lauryl sulfate, magnesium lauryl sulfate, cetyl sulfate, octyl sulfate, nonyl sulfate, decyl sulfate, 4-undeconal, 7-ethyl-2-methyl-sulfate, sodium salt (Niaproof Anionic Surfactant 4, available from Niacet Corporation, Niagra Falls, N.Y.), and the like.

"Alkoxy" and "alkoxyl" mean an alkyl-O— group wherein alkyl is defined herein. Representative alkoxy groups include methoxyl, ethoxyl, propoxyl, butoxyl, and the like.

"Alkyl" means a monovalent group derived from a straight or branched chain saturated hydrocarbon by the removal of a single hydrogen atom. Representative alkyl groups include methyl, ethyl, n- and iso-propyl, and the like.

"Alkyl phenol ethoxylate" means a nonionic surfactant compound of formula $R_5O(CH_2CH_2O)_pH$ where $R_5$ is phenyl, optionally substituted with one or two $C_8$–$C_{12}$ alkyl groups and p is 1–30 Preferred alkyl phenol ethoxylates are those where where $R_5$ is phenyl substituted with $C_9$ alkyl and p is 1–20 Alkyl phenol ethoxylates are available from Rhodia Inc., Cranbury, N.J. under the trade name Igepal.

"Alkylene" means a divalent group derived from a straight or branched chain saturated hydrocarbon by the removal of two hydrogen atoms. Representative alkylene groups include methylene, ethylene, propylene, and the like.

"Aryl" means an aromatic monocyclic or multicyclic ring system of about 6 to about 20 carbon atoms, preferably of about 6 to about 10 carbon atoms. Aryl also includes ring systems where two aryl groups are connected through alkylene, alkenylene or alkynylene groups. The aryl is optionally substituted with one or more alkyl, alkoxy or haloalkyl groups. Representative aryl groups include phenyl, biphenyl, naphthyl, cis- and trans-stilbene, biphenylmethyl, diphenylacetylene, and the like.

"Arylalkyl" means means an aryl group attached to the parent molecular moiety through a $C_1$–$C_8$ alkylene group. $C_1$–$C_2$ alkylene groups are preferred. Representative arylalkyl groups include phenylmethyl, phenylethyl, phenylpropyl, 1-naphthylmethyl, and the like.

"Cellulosic pulp" means a mixture of fibers derived from kraft or sulfite pulping of cellulosic materials such as wood. Representative cellulosic pulps include bleached and unbleached pulps and dissolving pulps. Typical bleached pulps contain about 60 to about 70 percent cellulose, about 30 to about 40 percent hemicellulose and less than about one percent lignin. Unbleached pulps generally contain about 65 to about 75 percent cellulose, about 20 to about 30 percent hemicellulose and up to about 5 percent lignin. Dissolving pulps are about 100 percent cellulose.

"Cycloalkyl" means a non-aromatic mono- or multicyclic ring system of about 5 to about 10 carbon atoms. Preferred ring sizes of rings of the ring system include about 5 to about 6 ring atoms. The cycloalkyl is optionally substituted with one or more substituents selected from alkyl, alkoxy and haloalkyl. Representative cycloalkyl include cyclopentyl, cyclohexyl, cycloheptyl, and the like.

"Dialkyl sulfosuccinate" means an anionic surfactant compound of formula $R_9OOCCH_2CH(SO_3M)COOR_{10}$, where $R_9$ and $R_{10}$ are independently selected from amyl, octyl, 2-ethyl hexyl, isobutyl, tridecyl, or lauryl and M is as defined herein. A representative dialkyl is dioctylsulfosuccinate. Dialkyl sulfosuccinates are commercially available from Cytec Industries, West Patterson, N.J.

"Fatty Acid Ethoxylate" means a nonionic surfactant compound of formula $R_7COO(CH_2CH_2O)_rH$ where $R_7$ is $C_7$–$C_{25}$ alkyl and r is 1–30. Fatty acid ethoxylates are commercially available from Henkel Corporation, Emery Group, Ambler, Pa.

"Hydroxyalkyl" means a $C_1$–$C_8$ alkyl substituted by one to three hydroxyl groups with the proviso that no more than one hydroxy group may be attached to a single carbon atom of the alkyl group. Representative hydroxyalkyl include hydroxyethyl, 2-hydroxypropyl, and the like.

"Market pulp" means chemical paper grade pulps which are typically sold on the open market to non-integrated paper mills (i.e. paper mills not having a pulp mill on-site). Market pulp also includes fluff pulp, which is used in diapers and related sanitary products, and dissolving pulp which is used in rayon manufacture. End uses for market pulp include paper and board manufacture, absorbent products (diapers, feminine care products, etc.), nonwovens, rayon and other cellulose derivatives.

"Pulp Slurry" means a slurry of cellulosic pulp as defined herein in water. Typical pulp slurries have a consistency (weight percent of cellulosic fibers) of about 0.2 to about 4 percent. Typical market pulp slurries have a consistency of about 0.5 to about 2 percent.

"Sulfonate" means an anionic surfactant compound of the formula $R_8SO_3M$ where $R_8$ is $C_8C_{18}$ alkyl, a $C_3$–$C_{12}$ cycloalkyl, $C_8$–$C_{18}$ aryl or $C_8$–$C_{18}$ alkylaryl group. Representative sulfonates include dodecyl sulfonate, tetradecyl sulfonate, alkylbenzenesulfonic acids (ABSA) and salts of alkylbenzenesulfonic acids, alkylbenzenesulfonates (ABS), linear alkylbenzenesulfonates, paraffin sulfonates, petroleum sulfonates and alpha olefin sulfonates. Sulfonates are available commercially from Stepan Company, Northfield, Ill.

"Sulfosuccinic acid ester with ethoxylated alcohols" means an anionic surfactant compound of formula $R_{11}(OCH_2CH_2)_tOOCH(SO_3M)CH_2COOM$ where $R_{11}$ is $C_8$–$C_{18}$ hydroxyalkyl, t is an integer from 1 to about 10 and M is as defined herein. A representative sulfosuccinic acid ester with ethoxylated Alcohol is laureth sulfosuccinate (Schercopol LPS, available from Scher Chemicals, Inc., Clifton, N.J.).

PREFERRED EMBODIMENTS

This invention is a dual surfactant system comprising one or more anionic surfactants and one or more nonionic surfactants for improving the dewatering of an aqueous cellulosic pulp slurry.

In a preferred aspect of this invention, the anionic surfactants are selected from the group consisting of alcohol sulfates, alcohol alkoxy sulfates, sulfonates, dialkyl sulfosuccinates and sulfosuccinic acid esters with ethoxylated alcohols.

In another preferred aspect, the nonionic surfactants are selected from the group consisting of alcohol ethoxylates, alkyl phenol ethoxylates, fatty acid ethoxylates and alcohol ethoxylates.

In another preferred aspect, the anionic surfactant is selected from the group consisting of alcohol sulfates and alcohol alkoxy sulfates and the nonionic surfactant is selected from the group consisting of alcohol ethoxylates and alkyl phenol ethoxylates.

In another preferred aspect, the anionic surfactants are selected from the group consisting of sodium dodecylsulfate and sodium lauryl ether sulfate.

In another preferred aspect, the nonionic surfactants are selected from the group consisting of secondary linear alcohol ethoxylates and nonylphenol ethoxylates.

The optimal amounts of anionic and nonionic surfactant are empirically determined based upon the characteristics of the pulp being dewatered. In general, the dose of anionic surfactant is from about 0.05 to about 10 lb/ton, preferably from about 0.25 to about 0.75 lb/ton, based on pounds of active ingredient per ton of dry pulp. The dose of nonionic surfactant is typically from about 0.001 to about 10 lb/ton, preferably from about 0.25 to about 0.75 lb/ton, based on pounds of active ingredient per ton of dry pulp.

The anionic and nonionic surfactant can be added in any order or simultaneously.

The surfactants are mixed with the pulp after it has been washed (to remove residual pulping/bleaching chemicals), and before the pulp is vacuum dewatered during the mat consolidation process. For example, the surfactants may be added just prior to the headbox on a fourdrinier pulp dryer.

In another preferred aspect of this invention, an effective amount of one or more defoamers is added to the pulp slurry.

Representative defoamers include $C_8$–$C_{48}$ alcohols in water with an emulsifier, $C_8$ to $C_{48}$ alkoxylated alcohols, such as ethoxylated propoxylated alcohols, silicones, wax (in ppm levels only), silica and ethylene bis stearamide (particulate suspended in oil) compounds, and blend(s) of a triglyceride ester and a polyethylene glycol ester. A preferred defoamer is a 10% actives blend of $C_{16}$ and $C_{18}$ alcohols. Defoamers are available from Ondeo Nalco Company, Naperville, Ill. or other companies, or can be readily synthesized using techniques known in the art.

The optimal amount of defoamer is empirically determined based upon the characteristics of the pulp being dewatered. In general, from about 0.5 to about 10 lb/ton, preferably from about 1 to about 3 lb/ton, based on pounds of defoamer product per dry ton of pulp is used.

The defoamer may be added before, after or simultaneously with the anionic and nonionic surfactants.

In another preferred aspect of this invention, an effective amount of one or more coagulants is added to the pulp slurry.

Representative coagulants include polyamines including dimethylamine-epichlorohydrin, polyamidoamines including condensation polymers of diethylene triamine and adipic acid, polyethyleneimine, poly(diallyldimethylammonium chloride), EDC/$NH_3$ polymers, acrylamide/dimethylaminoethyl methacrylate methyl chloride salt copolymer, acrylamide/dimethylaminoethylacrylate methyl chloride salt copolymer, poly(dimethylaminoethylacrylate methyl chloride salt), poly(dimethylaminoethyl methacrylate methyl chloride salt), polyacrylic acid and salt thereof, acrylic acid/diallyldimethylammonium chloride copolymer, acrylamide/diallyldimethylammonium chloride copolymers, alum, polyaluminum chloride and other aluminum based coagulants, polyvinylamine, and copolymers of vinylamine with vinylformamide, vinyl acetate, vinyl alcohol, and acrylamide.

All of these coagulants are available commercially or can be readily synthesized using techniques known in the art.

Typical coagulant dose is from about 0.1 to about 20 lb/ton, preferably from about 0.2 to about 10 lb/ton and more preferably from about 0.5 to about 6 lb/ton, based on polymer actives per dry ton of pulp.

The coagulant is added before, after or simultaneously with the addition of the anionic and nonionic surfactants. Preferably, the coagulant is added before the surfactants and before the defoamer, if a defoamer is added.

After addition of the nonionic and anionic surfactants, coagulants and defoamers, the pulp is dewatered, preferably on a "fourdrinier" or "cylinder" machine.

In a fourdrinier machine, the pulp (also known as a "stock slurry" at from about 0.5 to about 2 percent consistency) is deposited from a headbox onto a continuous, moving open mesh fabric. The water in the slurry drains through the fabric thus forming a pulp mat. After the initial free drainage through the fabric or wire, the mat is further dewatered as it is carried on the wire by the application of progressively increasing vacuum. The vacuum is applied to the underside of the mat by a series of elements known as vacuum boxes. Vacuum may also be applied at the couch roll, just prior to the removal of the mat from the forming fabric. Nominal mat consistency at this point is about 16% to about 20%. The pulp mat then enters the press section of the machine, which typically consists of from two to four press nips, where further water is removed by mechanical expression. The nominal mat consistency after pressing is from about 40% to about 45%. After the press section, further water is removed by evaporative means, typically by hot air impingement. The final consistency of the sheet is typically in the range of from about 81% to about 86% (oven-dry basis) or from about 90% to about 95% (air-dry basis).

In a cylinder machine, the stock slurry is contained in a vat and a rotating, fabric-covered cylinder is used in forming the mat. The stock in the vat is picked up onto the cylinder and drainage of water occurs through the fabric/screen to form the mat. The mat is further vacuum dewatered on the cylinder, whereupon it is transferred to a press section and dryer section as described for the fourdrinier machine.

Dewatering can be maximized by working to achieve optimal performance of the mechanical water removal sections (vacuum, press, and dryer). In order to maximize dewatering, the stock temperature is kept as high as possible, typically as high as from about 150 ° F. to about 160 ° F. (about 65° C. to about 71° C.) to enhance water removal by lowering the water viscosity. Also, steam boxes can be used to increase the temperature of the mat prior to the press section. The pulp pH is kept low, from about 4 to about 5, so that the fibers are less swollen and drain more easily.

The foregoing may be better understood by reference to the following Examples, which are presented for purposes of illustration and are not intended to limit the scope of this invention.

In the following Examples, "SDS" means sodium dodecyl sulfonate; "NPE" means nonylphenol ethoxylate; "LAE 1" means a $C_{11}$–$C_{15}$ secondary linear alcohol ethoxylate containing 5 moles of ethoxylation (Tergitol 15S-5, Union Carbide, Danbury, Conn.); "LAE 2" means a $C_{11}$–$C_{15}$ secondary linear alcohol ethoxylate containing 7 moles of ethoxylation (Tergitol 15S-7, Union Carbide, Danbury, Conn.); "LAE 3" means a $C_{11}$–$C_{15}$ secondary linear alcohol ethoxylate containing 9 moles of ethoxylation (Tergitol 15S-5, Union Carbide, Danbury, Conn.); "NPE 1" means a nonylphenol ethoxylate containing 5 moles of ethoxylation (Igepal CO-520, Rhodia Inc., Cranbury, N.J.); "NPE 2" means a nonylphenol ethoxylate containing 8.5 moles of ethoxylation (Igepal CO-620, Rhodia Inc., Cranbury, N.J.); "NPE 3" means a nonylphenol ethoxylate containing 12 moles of ethoxylation (Igepal CO-720, Rhodia Inc., Cranbury, N.J.).

Drainage performance is evaluated by measuring vacuum break time using a VDT instrument. During VDT testing, the furnish is drained through an Ahlstrom 1278 filter paper (available from Ahlstrom Filtration, Inc, Mount Holy Springs, Pa.) under applied vacuum to form a pad. The time required to drain 400 ml of filtrate and the time required for removal of a continuous water phase from the pad (vacuum break time) are recorded. The vacuum pump is operated for one minute after the vacuum break and the vacuum value, referred to as the final pad vacuum, is recorded. The pad is removed from the VDT+ instrument, weighed, and dried in an oven at 105° C. The weight of the dry pad is used to determine the pad consistency.

The vacuum break time is a measure of the rate of water removal from the pulp. The final pad vacuum is inversely proportional to the air permeability of the pad. Good formation gives greater resistance to air channeling, resulting in a higher final pad vacuum. The pad consistency is a measure of the total extent of water removal. Higher pad consistencies correlate to increased dewatering efficiency.

EXAMPLE 1

This example shows the vacuum dewatering results, given as consistency, for an anionic surfactant, sodium dodecyl sulfate (SDS), and a nonionic surfactant, nonylphenol ethoxylate (NPE). A northern bleached kraft hardwood fiber furnish (NBHK Pulp A) is used at a consistency of 1.55 wt. %. The sample size for each test is 500 ml of the furnish which is heated to 150° F. The furnish is mixed at 800 rpm prior to drainage. The surfactants are added in sequence, nonionic followed by anionic, 20 seconds prior to drainage. A 60 second vacuum dewatering time is employed following air breakthrough. A pad basis weight of 180 lb/1000 $ft^2$ is targeted. The results are shown in Table 1.

TABLE 1

SDS and NPE Vacuum Dewatering Results for NBHK Pulp A.

| Surfactant | Level | Consistency (%) |
|---|---|---|
| Blank | — | 21.65 ± 0.10[2] |
| SDS | 0.625 | 26.02[3] |
| NPE | 0.625 | 22.37[3] |
| NPE/SDS | 0.25/0.625 | 26.76 |
| NPE/SDS | 0.625/0.625 | 27.91 |
| NPE/SDS | 1.0/0.625 | 27.83 |

[1]actives basis on OD fiber
[2]seven measurements
[3]two measurements

As shown in Table 1, the SDS provides over a four point improvement in pad consistency following vacuum dewatering, whereas the NPE provides less than a point improvement in consistency at the 0.625 lb/T addition level. The combination of NPE and SDS, both added at the 0.625 lb/T level, provides a total improvement of 6.26 points of consistency. This increase is greater than that which would have been predicted from the simple addition of the improvements provided by each surfactant alone.

EXAMPLE 2

This Example shows the free drainage (time to 400 ml) and final pressure difference across the pulp mat (final vacuum) for the pulp of Example 1. Additionally the time for air breakthrough across the pad is provided as the "time to break". The results are shown in Table 2.

TABLE 2

Further SDS and NPE Dewatering Results for NBHK Pulp A.

| Surfactant | Level (lb/T)[4] | Time to 400 ml (sec) | Time to Break (sec) | Final Vacuum (in. Hg) |
|---|---|---|---|---|
| Blank | — | 5.68 ± 0.17[5] | 6.31 ± 0.16[5] | 6.6 ± 0.1[5] |
| SDS | 0.625 | 5.86[6] | 6.92[6] | 8.0[6] |
| NPE | 0.625 | 5.79[6] | 6.51[6] | 6.7[6] |
| NPE/SDS | 0.25/0.625 | 5.62 | 6.62 | 8.6 |
| NPE/SDS | 0.625/0.625 | 5.52 | 6.81 | 9.2 |
| NPE/SDS | 1.0/0.625 | 5.74 | 6.67 | 9.3 |

[4]actives basis on OD fiber
[5]seven measurements
[6]two measurements

Examination of Table 2 reveals no difference caused by the surfactant treatments on the time required to collect 400 ml of filtrate and a small increase in the time to break. Of importance to the vacuum dewatering improvement is the final vacuum value. An improvement in the measured final vacuum indicates that the mat has been exposed to a higher vacuum during the experiment, which in turn is believed to provide the improvement in consistency. Note that the NPE provides little improvement in the final vacuum, but that the combination of NPE and SDS provides the highest levels of final vacuum.

EXAMPLE 3

This example further explores the synergy between nonionic and anionic surfactants in enhancing the vacuum dewatering of market pulp. Here three different linear alcohol ethoxylates (LAE) and three different nonylphenol ethoxylates (NPE) are investigated. Also two different anionic surfactants are employed which are sodium dodecyl sulfate (SDS) and sodium lauryl ether sulfate (SLES). The experimental conditions are similar to those described in the previous experiment except that a second northern bleached hardwood kraft market pulp (NBHK Pulp B) having a consistency of 1.7 wt. % is used. Nonionic surfactant is added first to the pulp, followed 10 seconds later by the anionic surfactant. Drainage is initiated 20 seconds after anionic surfactant addition.

An initial set of experiments is used to develop a dosage curve of the consistency improvements attainable from use of the anionic surfactants alone. These results are shown in Table 3, which also includes two mixed surfactant experiments, one with the SDS and one with SLES. In both cases the nonionic surfactant used is NPE2.

TABLE 3

Anionic Surfactant Dosage Experiments for NBHK Pulp B.

| Surfactant | Level (lb/T)[1] | Final Vacuum (in. Hg) | Consistency (%) |
|---|---|---|---|
| Blank | — | 7.4 | 25.67 |
| SDS | 0.5 | 9.0 | 28.50 |
| SDS | 0.75 | 9.6 | 29.69 |

TABLE 3-continued

Anionic Surfactant Dosage Experiments for NBHK Pulp B.

| Surfactant | Level (lb/T)[1] | Final Vacuum (in. Hg) | Consistency (%) |
|---|---|---|---|
| SDS | 1.0 | 10.6 | 30.96 ± 0.23[2] |
| NPE2/SDS | 0.5/0.5 | 12.2 | 32.74 |
| SLES | 0.5 | 9.9 | 30.23 |
| SLES | 0.75 | 11.9 | 31.97 |
| SLES | 1.0 | 12.9 | 32.95 |
| NPE2/SLES | 0.5/0.5 | 13.0 | 33.22 |

[1]surfactant actives on OD fiber basis
[2]three measurements

Table 3 shows that the SLES provides superior improvements in consistency compared to SDS. The improvements in consistency again correspond with improvements in the final vacuum readings. When 0.5 lb/T NPE2 is used with 0.5 lb/T SDS, an improvement in consistency of 4.24 points is observed over the use of 0.5 lb/T SDS alone. This result is better than simply doubling the SDS dose to 1.0 lb/T. Similarly a dose of 0.5 lb/T NPE2 with 0.5 lb/T SLES results in a consistency that is 2.99 points above that provided by 0.5 lb/T of SLES alone. Again this result is better than if the SLES dose is doubled to 1.0 lb/T.

EXAMPLE 4

A set of experiments using 0.5 lb/T SDS and six representative nonionic surfactants, each at three addition levels is shown in this Example. These results are summarized in Table 4. Note that each of the values provided for the 0.5 lb/T level of nonionic surfactant is the average of two measurements.

TABLE 4

Surfactant Dosage Experiments for NBHK Pulp B.

| Surfactant | Level (lb/T)[1] | Final Vacuum (in. Hg) | Consistency (%) |
|---|---|---|---|
| Blank (SDS only) | — | 9.0 | 28.5 |
| NPE1 | 0.25 | 10.6 | 31.09 |
| | 0.50 | 11.8 | 32.14 |
| | 0.75 | 12.3 | 32.96 |
| NPE2 | 0.25 | 10.7 | 30.68 |
| | 0.50 | 11.8 | 32.26 |
| | 0.75 | 13.0 | 33.52 |
| NPE3 | 0.25 | 10.9 | 31.17 |
| | 0.50 | 12.2 | 32.70 |
| | 0.75 | 12.7 | 33.03 |
| LAE1 | 0.25 | 11.1 | 31.44 |
| | 0.50 | 12.2 | 32.70 |
| | 0.75 | 13.0 | 33.40 |
| LAE2 | 0.25 | 11.0 | 30.98 |
| | 0.50 | 12.1 | 32.42 |
| | 0.75 | 13.0 | 33.64 |
| LAE3 | 0.25 | 11.0 | 31.38 |
| | 0.50 | 12.3 | 32.96 |
| | 0.75 | 13.1 | 33.54 |

[1]Level of nonionic surfactant actives as lb/T on OD fiber

The data in Table 4 shows that as much as five points in consistency is gained from the addition of 0.75 lb/T of nonionic surfactant to the blank value of 0.5 lb/T SDS only. In all cases the addition of 0.5 lb/T nonionic surfactant (in addition to the 0.5 lb/T SDS) provides an improved consistency result compared to just doubling the SDS dose (see Table 3). The improvements in consistency again correlate with improvements in final vacuum. The nonionic surfactant effect appears quite general as it is documented for three variants, each representing two different types of surfactant.

Although this invention has been described in detail for the purpose of illustration, it is to be understood that such detail is solely for that purpose and that numerous modifications, alterations and changes can be made therein by those skilled in the art without departing from the spirit and scope of the invention except as it may be limited by the claims. All changes which come within the meaning and range of equivalency of the claims are to be embraced within their scope.

We claim:

1. A method of dewatering an aqueous cellulosic pulp slurry comprising a) adding to an aqueous slurry of washed cellulosic pulp an effective dewatering amount of a mixture of one or more nonionic surfactants selected from the group consisting of alcohol ehtoxylates, alkyl phenol ethoxylates and fatty acid ethoxylates and one or more anionic surfactants selected from the group consisting of alcohol sulfates, alcohol alkoxy sulfates, sulfonates, dinlkyl sulfosuccinates and sulfosuccinic acid esters with ethoxylated alcohols; and b) dewatering the pulp.

2. The method of claim 1 wherein the anionic surfactant is selected from the group consisting of alcohol sulfates and alcohol alkoxy sulfates and the nonionic surfactant is selected from the group consisting of alcohol ethoxylates and alkyl phenol ethoxylates.

3. The method of claim 2 wherein the alcohol sulfate is sodium dodecylsulfate and the alcohol alkoxy sulfate is sodium lauryl ether sulfate.

4. The method of claim 2 wherein the alcohol ethoxylates are selected from the group consisting of secondary linear alcohol ethoxylates and the alkyl phenol ethoxylates are selected from the group consisting of nonylphenol ethoxylates.

5. The method of claim 1 further comprising adding an effective defoaming amount of one or more defoamers to the pulp slurry.

6. The method of claim 5 wherein the defoamer is a blend of $C_{16}$ and $C_{18}$ alcohols.

7. The method of claim 1 further comprising adding one or more coagulants to the pulp slurry.

8. The method of claim 1 wherein the aqueous celluslosic pulp slurry is a market pulp slurry.

* * * * *